US005203565A

United States Patent [19]

Murray et al.

[11] Patent Number: 5,203,565

[45] Date of Patent: Apr. 20, 1993

[54] GOLF CLUB HEAD

[76] Inventors: Tom R. Murray, 1914 Carriage La., Crete, Ill. 60417; Jack J. Murray, 9800 Olcott Ave., St. John, Ind. 46375

[21] Appl. No.: 824,223

[22] Filed: Jan. 22, 1992

[51] Int. Cl.[5] ..... A63B 53/04

[52] U.S. Cl. ..... 273/164.1; 273/167 E; 273/167 A; 273/169

[58] Field of Search ..... 273/167–175, 273/193 R, 194 R, 77 A, 77 R, 78, 186 A, 183 D, 164; D21/214–220

[56] References Cited

U.S. PATENT DOCUMENTS

| | | | |
|---|---|---|---|
| D. 149,156 | 3/1948 | Weatherington | 273/164 X |
| D. 275,412 | 9/1984 | Simmons . | |
| 1,541,126 | 3/1923 | Dunn . | |
| 1,913,821 | 6/1933 | Stumpf | 273/174 X |
| 1,916,792 | 7/1933 | Hadden | 273/167 A |
| 2,550,846 | 5/1951 | Milligan | 273/167 A |
| 3,166,320 | 11/1961 | Onions . | |
| 3,814,437 | 6/1974 | Winquist | 273/169 X |
| 4,444,392 | 4/1984 | Duclos . | |
| 4,653,756 | 3/1987 | Sato . | |
| 4,762,322 | 8/1988 | Molitor et al. . | |
| 4,804,188 | 2/1989 | McKee et al. . | |
| 4,850,593 | 7/1989 | Nelson . | |
| 4,858,929 | 8/1989 | Long . | |
| 4,995,609 | 2/1991 | Parente et al. . | |
| 5,026,056 | 6/1991 | McNally et al. . | |

*Primary Examiner*—V. Millin
*Assistant Examiner*—Sebastiano Passaniti
*Attorney, Agent, or Firm*—Dennison, Meserole, Pollack & Scheiner

[57] ABSTRACT

A golf club head for striking a golf ball. The golf club head including a pair of channels. The first channel extending from the front face through the area defined by the heel of the club. The second channel extending from the front face through the area defined by the toe of the club. The channels ending in the rear area of the club and forming a divider for aligning the club head. The pair of channels causing air to flow substantially unobstructed during movement of the golf club head towards striking the golf ball. The divider for aligning nearly eliminating rotational movement of the club head by forcing the air passing through the pair of channels to grip the divider, and hold the club head steady at impact.

15 Claims, 3 Drawing Sheets

GOLF CLUB HEAD

CROSS REFERENCE TO RELATED APPLICATION

This application is related to a co-pending Design Patent Application entitled Golf Club Head by Murray et al. The teachings of that co-pending application are hereby incorporated by reference.

BACKGROUND OF THE INVENTION

Golf is a game wherein the ideal striking of a golf ball generates a shot which is long and straight. Normally, the driver is the club which accomplishes this task, because it is the club used to hit the golf ball as far as possible.

By generating high club head speed at impact, the flight of the golf ball is prolonged. But, as the club head moves toward impact, air directly effects the club head, and reduces the possibility for the ideal striking of the golf ball.

Aerodynamic effects of golf club heads have been investigated through the years. U.S. Pat. No. 1,541,126 to Dunn attempted to raise the center of gravity of the golf club by forming the golf club head with a concave sole. U.S. Pat. No. 3,166,320 to Onions provides a groove extending across the rear of the club head to reduce bounce. U.S. Pat. No. 4,444,392 to Duclos recognized an aerodynamic drag or vacuum at the rear of the club head and developed an internal cavity in an attempt to eliminate the vacuum. U.S. Pat. No. 4,850,593 to Nelson also recognized the aerodynamic drag near impact and utilized a sole trough to reduce this drag at the top of the swing rather than near impact.

Each of the noted patents have recognized one element effecting the speed of the club head near impact. However, not only is there an aerodynamic drag or vacuum near the rear of the club head, but the air moving around the club head also causes rotational movement of the club head. This rotational movement rotates the club head near impact and thus at impact the face of the club head is either opened or closed. This type of striking causes side spin on the ball. It is well known that a golf ball with side spin does not fly straight. Instead, depending on the amount and direction of spin, the ball will either hook or slice.

SUMMARY OF THE INVENTION

The foregoing problems and shortcomings of the prior art are corrected according to the present invention by utilizing an aerodynamic shaped golf club head. The golf club head of the present invention guides the passing air around the golf club head substantially unobstructed to reduce drag and air resistance. The golf club head includes a pair of U-shaped channels which allow the air to flow substantially unobstructed during movement of the golf club head towards striking the golf ball.

Accordingly, it is an object of the invention to provide a pair of channels extending from the face of the club head through the toe area and heel area respectively.

It is another object of the invention to provide an I-shaped divider at the rear of the golf club head.

It is a further object of the invention to provide center mass weighting in the golf club head.

It is an object of the invention to eliminate the aerodynamic drag or vacuum.

Another object of the invention is to eliminate the rotational movement of the club head near impact.

Further objects and advantages of the invention will become apparent from a consideration of the drawings and the ensuring description.

DESCRIPTION OF THE INVENTION

Figure 6:
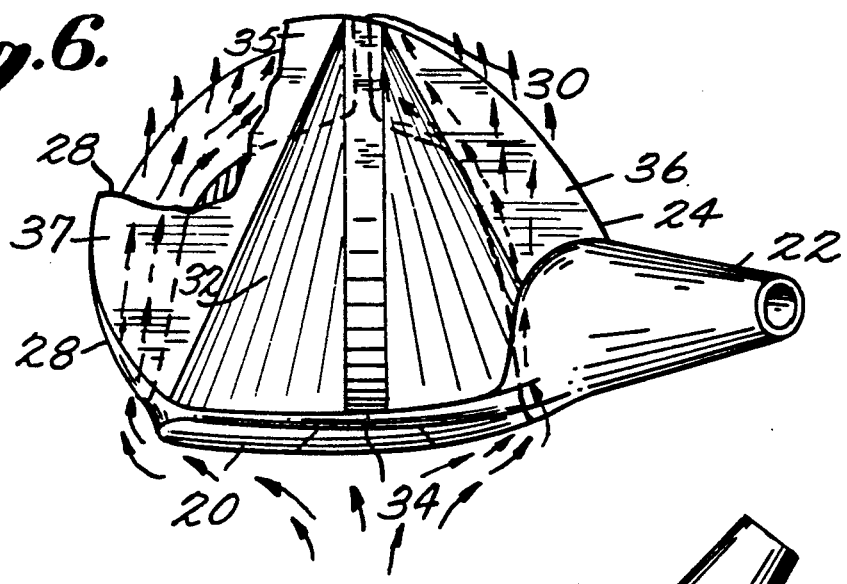
FIG. 6 shows a crown plan view with a cutout portion and wind directional arrows.
Figure 5:
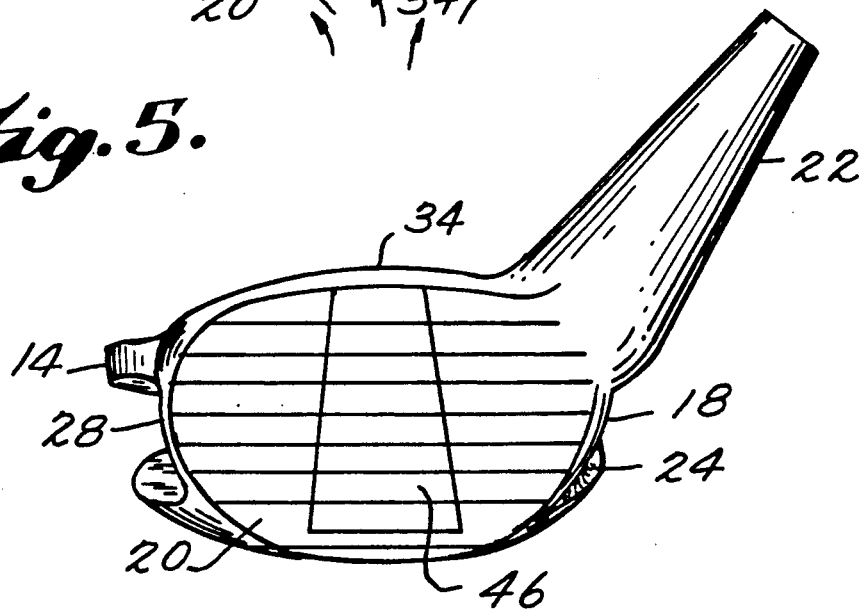
FIG. 5 shows a face elevational view of the golf club head.
Figure 8:
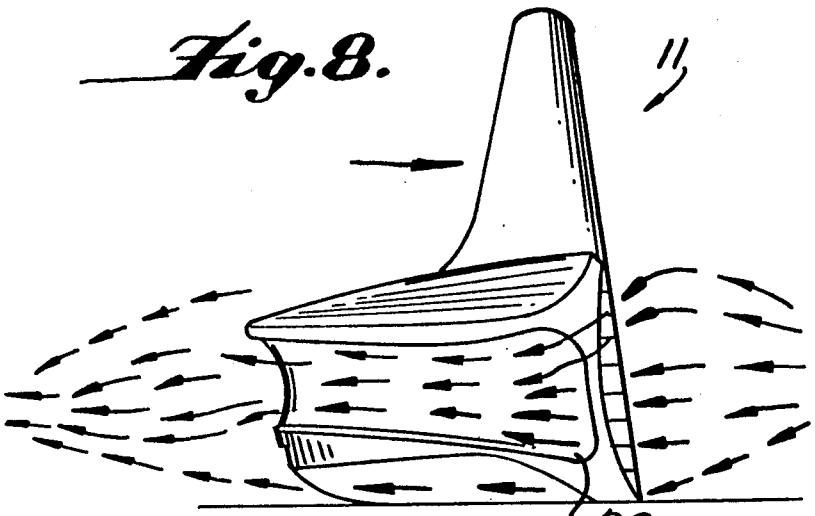
FIG. 8 shows a toe elevational view with indications for air resistance.
Figure 10:
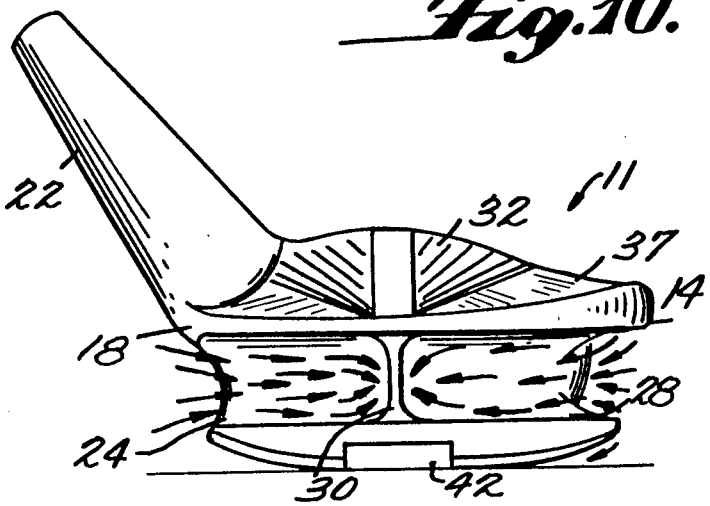
FIG. 10 shows a rear elevational view of the club head in movement close to impact.
Figure 7:
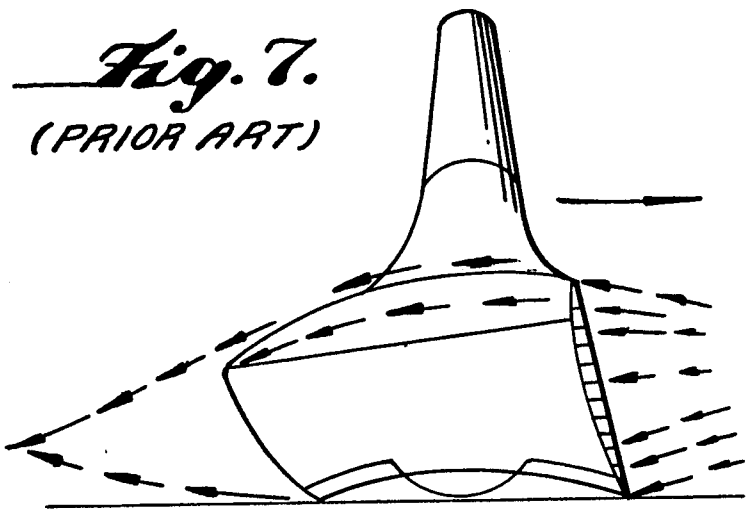
Fig. 7. (PRIOR ART)
FIG. 7 illustrates a toe elevational view of a prior art club head.
Figure 9:
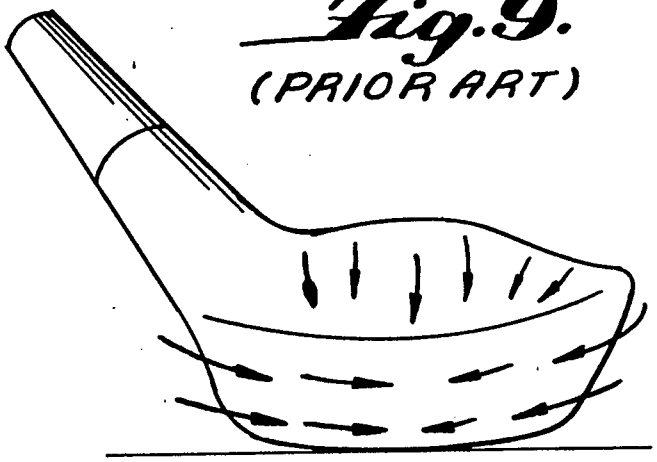
Fig. 9. (PRIOR ART)
FIG. 9 shows a prior art club head in a rear elevational view.

Referring to the drawings, FIGS. 1 through 5 illustrate the golf club head 11 in a stationary position. FIGS. 6, 8 and 10 illustrate the golf club head prior to impact with a golf ball (not shown). FIGS. 7 and 9 illustrate a prior art golf club head.

Initially, the golf club head 11 is described with reference to FIGS. 1 through 5.

The golf club head 11 is comprised of a crown or top portion 12. The other extremities of the golf club head 11 are the toe 14, sole 16 and heel 18. The face 20 of the club head 11 is the hitting surface for the golf club head 11. Hosel 22 extends from the heel 18 and crown 12 to interfit with a shaft (not shown).

Figure 1:
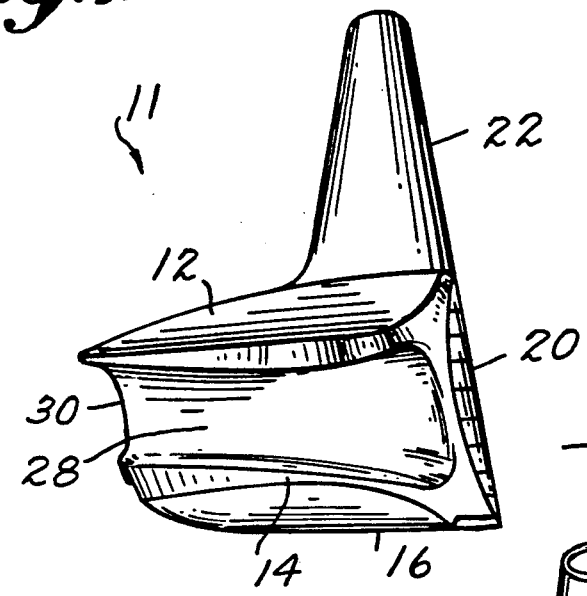
FIG. 1 is a toe elevational view of the golf club head.
Figure 2:
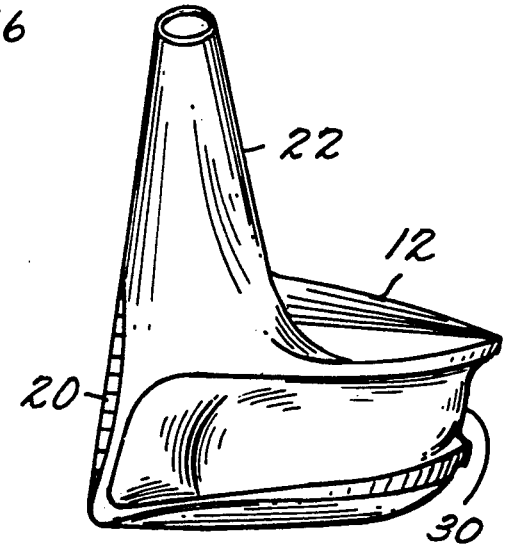
FIG. 2 shows a heel elevational view of the golf club head.
Figure 3:
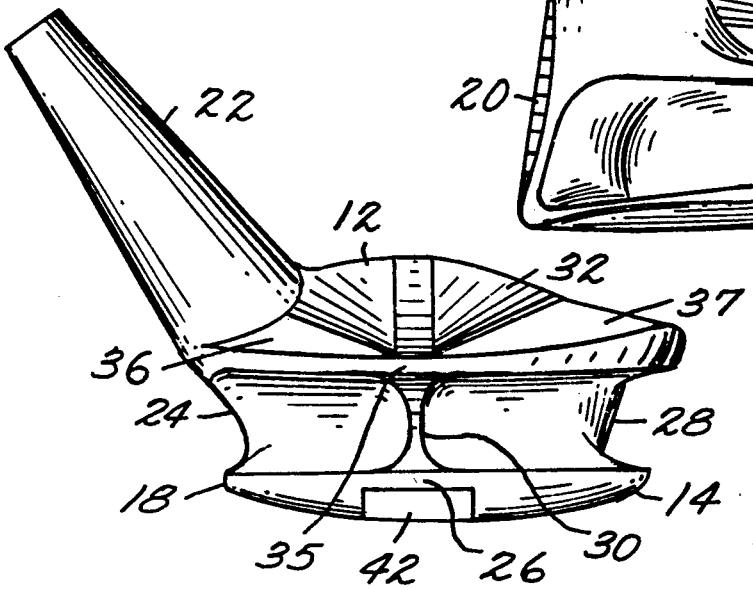
FIG. 3 is a rear elevational view of the golf club head for the preferred embodiment.

In the golf club head 10 of the present invention, with reference to FIGS. 1 through 3, there exists two hollow U-shaped grooves or channels. The first channel 24 extends from the face 20 beneath the hosel 22. This heel channel 24 extends around the rear perimeter of the golf club head 11 and through the heel area 18 until reaching rear area 26.

A similar second channel extends from the face 20 through the toe 14 around the rear perimeter of the golf club head 11 and ends at the rear area 26. These two channels 24 and 28 are nearly symmetrically shaped and are positioned on the same radial axis. Of course, it is contemplated that the channels can be smaller or larger than each other. In other words, the channels do not have to be symmetrical. The channels meet in the rear area 26 and are separated by an I-shaped connecter 30. The I-shaped connecter or divider 30 divides the two channels. The divider also connects the crown 12 to the sole 16.

The crown 12 of golf club head 11 is somewhat unique in shape. The crown 12 includes a slightly V-shaped wedge 32. As shown in FIGS. 3 and 6, the wedge 32 extends from a high point 34 where the crown 12 meets the top of the face 20 to a low point 35 where the wedge 32 meets the I-shaped divider 30. The wedge 32 tapers towards the heel area 18 and towards the toe area 14. At these places, the crown 12 is relatively flat. The first flat area 36 is over the heel channel 24 and extends from the hosel 22 to the tip 35 of the V-shaped wedge 32. The second flat area 37 is over the toe channel 28 and extends from the toe 14 to the tip 35 of the V-shaped wedge 32.

Figure 4:
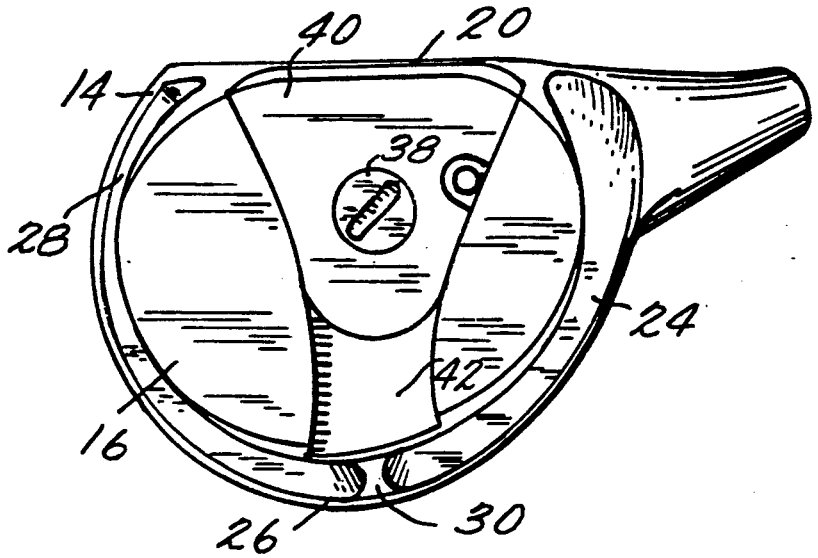
FIG. 4 is a sole plan view of the golf club head.

The sole 16 of golf club head 11 is shown in FIG. 4. Screw 38 mounts sole plate 40 to the sole 16. The sole 16 includes a tapered sole groove 42 extending from the face 20 of the club head 11 to the rear area 26. The groove 42 provides a holding and mounting area for sole plate 40. The groove 42 extends from face 20 to rear area 26, the sole plate 40 can be changed for different sizes depending on the desired weight. Also, the groove 42 provides an aerodynamic channel for air to move through the sole 16 during a golf swing.

The aerodynamic effects on golf club head 11 are illustrated in FIGS. 6, 8 and 10. FIGS. 7 and 9 illustrate a commonly used club head without channels. As can be seen in FIG. 7, during the golf swing a vacuum area 44 is formed behind the club head. This vacuum 44 causes resistance and thus reduces swing speed at impact of a golf ball.

Furthermore, as shown in FIG. 9, the air moving around a golf club will cause the club to rotate prior to impact. This rotation of the club head will directly effect the angle the club face strikes the ball. An open or closed face at impact will change the flight and decrease the distance of a driven golf ball.

Golf club head 11 reduces air resistance by maintaining as much as possible the natural flow of the air around and through the club head 11. FIGS. 6 and 8 illustrate the flow of the air through the heel channel 24 and the toe channel 28 as well as the sole groove 42.

As can be seen in FIG. 8, the vacuum area 44 has been eliminated. The elimination of this air resistance allows the club head 11 to move faster near impact. By increasing the club head's speed near impact, a longer drive of a golf ball results.

FIG. 10 illustrates a gripping effect caused by the air moving through both channels 24 and 28 as well as groove 42. The air traveling through the channels 24, 28 and the groove 42 meet at the I-shaped divider 30 and grip the I-shaped divider 30. This gripping reduces rotational movement of the club head 11 and thus results in a much straighter driving of a golf ball.

An added advantage club head 11 has over the previously designed club heads is the positioning of the inner mass. As is commonly know, the amount of hooking or slicing of a driven golf ball is directly related to the center of gravity of the club head. The further the center of gravity is from the front face, the less chance of striking the golf ball with the sweet spot area. The sweet spot is generally indicated by number 46 and illustrated in FIG. 5.

As can be seen in the drawings, the center of gravity of club head 11 is as close as possible to the front face 20. The channels 24 and 28 force the inner mass of club head 11 closer to the front face 20. Wedge 32 allows the center of mass of the club head 11 to be moved closer to the front face 20 and the sweet spot 46. Club head 11 includes center mass weighting as well as hell-toe weighting by putting as much of the total mass at the area of impact. The CMW (center mass weighting) advantage results in a decrease of rotational movement and an increase in the speed of the club head 11 at impact.

While the above description contains many specificities, these should not be construed as limitations on the scope of the invention, but rather as exemplification of one preferred embodiment thereof. Many other variations are possible. For example, the size of the channels can be changed to shift or move the center mass weighting either closer to the heel or closer to the toe. Also, the sole groove can be increased or decreased by adding different sized sole plates. Accordingly, the scope of the invention should be determined not by the embodiment illustrated, but by the appended claims and their legal equivalence.

What is claimed is:

1. A golf club head comprising:

a front face for striking a golf ball;

a crown portion connected to said front face for defining a top portion of said golf club head, said top portion defining a top area having a slightly V-shaped tapering wedge with a high point near said crown portion adjacent said front face and extending generally rearwardly away from said front face to substantially zero taper;

a sole portion connected to said front face for defining a bottom portion of said golf club head, said bottom portion defining a bottom area substantially equal to said top area;

a heel portion connecting said crown portion to said sole portion for defining a first side portion of said golf club head;

a toe portion connecting said crown portion to said sole portion for defining a second side portion of said golf club head;

a rear portion connecting said crown portion to said sole portion for defining a back side portion of said golf club head;

a hosel extending from said crown portion near said heel portion and adjacent said front face for connecting said golf club head to a golf club shaft;

a first U-shaped channel extending from said front face through said heel portion and to said rear portion;

a second U-shaped channel extending from said front face through said toe portion and to said rear portion; and I-shaped means formed in said rear portion between said crown portion and said sole portion for separating said first U-shaped channel from said second U-shaped channel and for guiding air rearwardly from said front face of said golf club head during movement toward striking the golf ball.

2. The golf club head of claim 1, wherein said first U-shaped channel guides air passing around said heel portion in an aerodynamic path and nearly equivalent to a natural flow of the passing air.

3. The golf club head of claim 1, wherein said second U-shaped channel guides air passing around said toe portion in an aerodynamic path and nearly equivalent to a natural flow of the passing air.

4. The golf club head of claim 1, wherein said first and second U-shaped channels funnel passing air substantially adjacent said I-shaped means to nearly eliminate any back vacuum and for increasing velocity of said golf club head.

5. The golf club head of claim 4, wherein said first and second U-shaped channels funnel the passing air toward said I-shaped means with the passing air gripping said I-shaped means on each respective side to prevent rotational movement of said golf club head.

6. The golf club head of claim 5, wherein said first and second U-shaped channels force an inner mass of said golf club head into a centralized zone for creating center mass weighting within said defined golf club head.

7. A golf club head for striking a golf ball, said head comprising:

a top part defining a crown of said golf club head, said crown defining a crown area having a slightly V-shaped tapering wedge with a high point near said crown adjacent said top part and extending generally rearwardly away from said front face to substantially zero taper;

a bottom part defining a sole of said golf club head, said sole defining a sole area substantially equal to said crown area;

a front face connecting said crown to said sole and for striking the golf ball;

a hosel extending from said crown for interfitting said golf club head to a golf club shaft;

a heel defining an area closest to said extending hosel and connecting said crown to said sole adjacent said front face;

a toe defining an area farthest away from said extending hosel and connecting said crown to said sole adjacent said front face;

a rear area substantially parallel with said front face and for connecting said crown to said sole; and two U-shaped channels, said first U-shaped channel extending from said front face through said heel area to said rear area, and said second U-shaped channel extending from said front face through said toe area to said rear area, said two U-shaped channels meeting at said rear area to form an I-shaped divider for separating said two U-shaped channels and for connecting said crown to said sole, said I-shaped divider forcing air moving through said two U-shaped channels away from said rear area.

8. The golf club head of claim 7, wherein said two U-shaped channels and said I-shaped divider forcing an inner mass of said golf club head substantially closer to said front face.

9. The golf club head of claim 8, wherein the forcing of said inner mass substantially closer to said front face creates center mass weighting in said golf club head.

10. The golf club head of claim 9, wherein said center mass weighting decreases rotational movement of said golf club head during striking of said golf ball.

11. A golf club head for striking a golf ball, comprising:

a top part defining a crown, said crown defining a crown area having a slightly V-shaped tapering wedge with a high point near said crown adjacent said top part and extending generally rearwardly away from said front face to substantially zero taper;

a bottom part defining a sole, said sole defining a sole area substantially equal to said crown area;

a front face connecting said crown to said sole;

a hosel extending from said crown and for interfitting said golf club head to a golf club shaft;

a heel defining an area near said hosel and adjacent said front face, said heel connecting said crown to said sole;

a toe defining an area opposite said heel and adjacent said front face, said toe connecting said crown to said sole;

a rear area opposite said front face and between said toe and said heel, said rear area connecting said crown to said sole;

a pair of channels, said first channel extending from said front face through said area defined by said heel, said second channel extending from said front face through said area defined by said toe, said channels ending in said rear area and forming means for aligning said golf club head, said pair of channels causing air to flow substantially unobstructed during movement of said golf club head towards striking the golf ball, and said aligning means during movement of said golf club head toward striking the golf ball nearly eliminating rotational movement of said golf club head by forcing the air passing through said pair of channels to grip said aligning means.

12. The golf club head of claim 11, wherein said sole includes a sole plate for preventing wear and tear to said sole.

13. The golf club head of claim 11, wherein said first channel guides air passing around said heel of said golf club head aerodynamically.

14. The golf club head of claim 11, wherein said second channel guides air passing around said toe of said golf club head aerodynamically.

15. The golf club head of claim 11, wherein said sole includes a sole groove for causing air to flow through said sole substantially unobstructed during movement of said golf club head toward striking the golf ball.

* * * * *